US011398201B2

(12) United States Patent
Zeng et al.

(10) Patent No.: US 11,398,201 B2
(45) Date of Patent: Jul. 26, 2022

(54) DATA PROCESSING METHOD FOR DISPLAY PANEL, AND DISPLAY APPARATUS

(71) Applicant: HKC CORPORATION LIMITED, Shenzhen (CN)

(72) Inventors: Dekang Zeng, Chongqing (CN); Shuixiu Hu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/042,062

(22) PCT Filed: Dec. 27, 2018

(86) PCT No.: PCT/CN2018/124174
§ 371 (c)(1),
(2) Date: Sep. 25, 2020

(87) PCT Pub. No.: WO2020/087735
PCT Pub. Date: May 7, 2020

(65) Prior Publication Data

US 2021/0012737 A1 Jan. 14, 2021

(30) Foreign Application Priority Data

Oct. 31, 2018 (CN) ..... 201811286454.4

(51) Int. Cl.
*G09G 3/36* (2006.01)

(52) U.S. Cl.
CPC ..... *G09G 3/3648* (2013.01); *G09G 2310/08* (2013.01); *G09G 2320/02* (2013.01); *G09G 2370/14* (2013.01)

(58) Field of Classification Search
CPC ..... G09G 2310/08; G09G 2320/02; G09G 2370/14; G09G 3/20; G09G 3/36; G09G 3/3648
See application file for complete search history.

(56) References Cited

U.S. PATENT DOCUMENTS

2016/0379590 A1* 12/2016 Ma ..... H04N 7/08 345/204

FOREIGN PATENT DOCUMENTS

CN 103794172 A 5/2014
CN 105336301 A 2/2016
(Continued)

OTHER PUBLICATIONS

How to Map RGB Signals to LVDS/OpenLDI(OLDI) Displays—User's Guide (Year: 2019).*
(Continued)

*Primary Examiner* — Ram A Mistry

(57) ABSTRACT

This application discloses a data processing method for a display panel, and a display apparatus. The data processing method includes steps of: setting a low-voltage differential signaling including data bits and a select status bit, and assigning a value to the select status bit according to a corresponding select low-voltage differential signaling; receiving, by a timing controller, the low-voltage differential signaling; and reading, by the timing controller, the select status bit of the low-voltage differential signaling, processing the low-voltage differential signaling according to the select status bit, and converting the low-voltage differential signaling into a data format corresponding to the select status bit.

14 Claims, 6 Drawing Sheets

(56) References Cited

FOREIGN PATENT DOCUMENTS

| | | | |
|---|---|---|---|
| CN | 106657838 | A | 5/2017 |
| CN | 107301841 | A | 10/2017 |
| CN | 107481674 | A | 12/2017 |

OTHER PUBLICATIONS

Chunli Ma, the ISA written comments, Aug. 2019, CN.
Chunli Ma, the International Search Report, Aug. 2019, CN.

* cited by examiner

DATA PROCESSING METHOD FOR DISPLAY PANEL, AND DISPLAY APPARATUS

CROSS REFERENCE OF RELATED APPLICATIONS

This application claims the priority to the Chinese Patent Application No. CN201811286454.4, filed with National intellectual Property Administration, PRC on Oct. 31, 2018 and entitled "DATA PROCESSING METHOD FOR DISPLAY PANEL, AND DISPLAY APPARATUS", which is incorporated herein by reference in its entirety.

TECHNICAL FIELD

This application relates to the display technology field, and in particular, to a data processing method for a display panel, and a display apparatus.

BACKGROUND

Statement herein merely provides background information related to this application and does not necessarily constitute the existing technology.

With development and advance of science and technology, due to hot spots such as thinness, power saving, and low radiation, liquid crystal displays become mainstream products of displays and are widely applied. Most liquid crystal displays in the market are backlight liquid crystal displays, including a liquid crystal panel and backlight module. The working principle of the liquid crystal panel is: Liquid crystal molecules are placed between two parallel glass substrates, and a drive voltage is applied across the two glass substrates to control rotating directions of the liquid crystal molecules, so that light in the backlight module is refracted out to generate an image.

Thin film transistor liquid crystal displays have gradually dominated the display field due to the properties of low power consumption, excellent image quality, high production yield and the like. A thin film transistor liquid crystal display includes a liquid crystal panel and a backlight module, the liquid crystal panel includes a color filter substrate and a thin film transistor array substrate, and transparent electrodes are arranged on opposite inner sides of the substrates. A layer of liquid crystal molecules is sandwiched between the color filter substrate and the thin film transistor array substrate.

The transmission format of a low-voltage differential signaling of a display apparatus is determined by a select low-voltage differential signaling. The level of the select low-voltage differential signaling may be disturbed by external signaling during transmission, which easily causes image abnormality on a display panel.

SUMMARY

This application is directed to provide a data processing method for a display panel and a display apparatus to integrate the function of a select low-voltage differential signaling so as to improve the stability of information transmission of a low-voltage differential signaling.

A data processing method for a display panel, including steps of:

setting a low-voltage differential signaling including data bits and a select status bit, and assigning a value to the select status bit according to a corresponding select low-voltage differential signaling;

receiving the low-voltage differential signaling by a timing controller; and reading the select status bit of the low-voltage differential signaling, processing the low-voltage differential signaling according to the select status bit, and converting the low-voltage differential signaling into a data format corresponding to the select status bit by the timing controller.

Optionally, in the step of setting a low-voltage differential signaling including data bits and a select status bit, and assigning a value to the select status bit according to a corresponding select low-voltage differential signaling:

when the select low-voltage differential signaling is at a high level, 1 is assigned to the select status bit.

Optionally, in the step of setting a low-voltage differential signaling including data bits and a select status bit, and assigning a value to the select status bit according to a corresponding select low-voltage differential signaling:

when the select low-voltage differential signaling is at a low level, 0 is assigned to the select status bit.

Optionally, the step of reading the select status bit of the low-voltage differential signaling, processing the low-voltage differential signaling according to the select status bit, and converting the low-voltage differential signaling into a data format corresponding to the select status bit by the timing controller includes:

when it is detected that the value of the select status bit is 1, processing the low-voltage differential signaling and converting the low-voltage differential signaling into a first data format by the timing controller.

Optionally, the step of reading the select status bit of the low-voltage differential signaling, processing the low-voltage differential signaling according to the select status bit, and converting the low-voltage differential signaling into a data format corresponding to the select status bit by the timing controller includes:

when it is detected that the value of the select status bit is 0, processing the low-voltage differential signaling and converting the low-voltage differential signaling into a second data format by the timing controller.

Optionally, the display panel further includes a low-voltage differential mode select circuit configured to output a select low-voltage differential signaling corresponding to the low-voltage differential signaling to the timing controller; the step of receiving the low-voltage differential signaling by a timing controller includes:

detecting whether the low-voltage differential signaling includes the select status bit, and if the low-voltage differential signaling includes the select status bit, turning off the low-voltage differential mode select circuit.

Optionally, after receiving the low-voltage differential signaling by a timing controller, the method includes the step of:

detecting whether the low-voltage differential signaling includes the select status bit, and if the low-voltage differential signaling does not include the select status bit, outputting, by the low-voltage differential mode select circuit, a select low-voltage differential signaling to the timing controller according to the low-voltage differential signaling without the select status bit.

Optionally, the timing controller processes the low-voltage differential signaling according to the select low-voltage differential signaling, and converts the low-voltage differential signaling into a data format corresponding to the select low-voltage differential signaling.

Optionally, the data length of the low-voltage differential signaling is more than or equal to 8 bits.

This application further discloses a data processing method for a display panel, including steps of:

setting a low-voltage differential signaling including data bits and a select status bit, and assigning a value to the select status bit according to a corresponding select low-voltage differential signaling;

receiving the low-voltage differential signaling by a timing controller; and reading, by the timing controller, the select status bit of the low-voltage differential signaling, processing the low-voltage differential signaling according to the select status bit, and converting the low-voltage differential signaling into a data format corresponding to the select status bit;

where after the step of setting a low-voltage differential signaling including data bits and a select status bit, and assigning a value to the select status bit according to a corresponding select low-voltage differential signaling further includes steps of, when the select low-voltage differential signaling is at a high level, assigning 1 to the select status bit; and when the select low-voltage differential signaling is at a low level, assigning 0 to the select status bit; and where after the step of reading, by the timing controller, the select status bit of the low-voltage differential signaling, processing the low-voltage differential signaling according to the select status bit and converting the low-voltage differential signaling into a data format corresponding to the select status bit further includes steps of, when it is detected that the value of the select status bit is 1, processing the low-voltage differential signaling and converting the low-voltage differential signaling into a first data format by the timing controller; and when it is detected that the value of the select status bit is 0, processing the low-voltage differential signaling and, converting the low-voltage differential signaling into a second data format by the timing controller.

This application further discloses a display apparatus, including: a driver board; a display panel electrically connected with the driver board; a transmitter arranged on the driver board and configured to transmit low-voltage differential signaling to the display panel; a receiver arranged on the display panel and configured to receive the low-voltage differential signaling; and a timing controller arranged on the display panel, electrically connected with the receiver, and configured to read a select status bit of the low-voltage differential signaling, process the low-voltage differential signaling according to the select status bit and convert the low-voltage differential signaling into a data format corresponding to the select status bit; the low-voltage differential signaling includes data bits and the select status bit.

Optionally, the transmitter is further configured to assign a value to the select status bit according to a corresponding select low-voltage differential signaling.

Optionally, 1 or 0 is assigned to the select status bit; the data format includes a first data format and a second data format corresponding to the assigned values respectively; when detecting that the value of the select status bit is 1, the timing controller processes the low-voltage differential signaling and converts the low-voltage differential signaling into the first data format; and when detecting that the value of the select status bit is 0, the timing controller processes the low-voltage differential signaling and converts the low-voltage differential signaling into the second data format.

Optionally, the display panel further includes a low-voltage differential mode select circuit coupled between the transmitter and the receiver, and a switching circuit coupled to the driver board and configured to control on or off of the low-voltage differential mode select circuit.

The driver board is further configured to detect whether the low-voltage differential signaling includes the select status bit, and if the low-voltage differential signaling includes the select status bit, the switching circuit is controlled to turn off the low-voltage differential mode select circuit; if the low-voltage differential signaling does not include the select status bit, the switching circuit is controlled to turn on the low-voltage differential mode select circuit, and the low-voltage differential mode select circuit outputs a select low-voltage differential signaling to the timing controller according to the low-voltage differential signaling.

Optionally, the timing controller processes the low-voltage differential signaling according to the select low-voltage differential signaling or the select status bit and converts the low-voltage differential signaling into a corresponding data format.

Optionally, the select low-voltage differential signaling transmitted by the low-voltage differential mode select circuit instructs the timing controller to perform decompression and output of the matched data format.

Optionally, the display panel is one of a Twisted Nematic Display Panel, an In-Plane Switching Display Panel, and a Multi-Domain Vertical Alignment Display Panel.

The transmission format of the low-voltage differential signaling of the display apparatus is determined by the select low-voltage differential signaling, and the level of the select low-voltage differential signaling may be disturbed by external factors, such as external static electricity, causing an image abnormality when the level of the select low-voltage differential signaling does not match the format of current transmitted low-voltage differential signaling. A low-voltage differential signaling including data bits and a select status bit is set, and a value is assigned to the select status bit according to a corresponding select low-voltage differential signaling; then, a timing controller of a display panel receives the low-voltage differential signaling output by a driver board; finally, the timing controller reads the select status bit of the low-voltage differential signaling, processes the low-voltage differential signaling according to the select status bit and converts the low-voltage differential signaling into a data format corresponding to the select status bit; in this way, the function of the select low-voltage differential signaling is integrated, and even if the low-voltage differential signaling is disturbed by external signaling, as long as the select status bit can be read, the low-voltage differential signaling can be ensured to be converted into the corresponding data format, so that the stability of information transmission is improved, in addition, the number of the timing, controller and low-voltage differential signaling input connectors is reduced, the number of traces of the timing controller and low-voltage differential signaling connectors on a printed circuit board is then reduced, the area of the printed circuit board is reduced, and the production cost of the display apparatus is lowered.

BRIEF DESCRIPTION OF DRAWINGS

The drawings included are adopted to provide understanding of embodiments of this application, constitute part of the specification, and are used for illustrating implementation manners of this application, and interpreting principles of this application together with text description. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
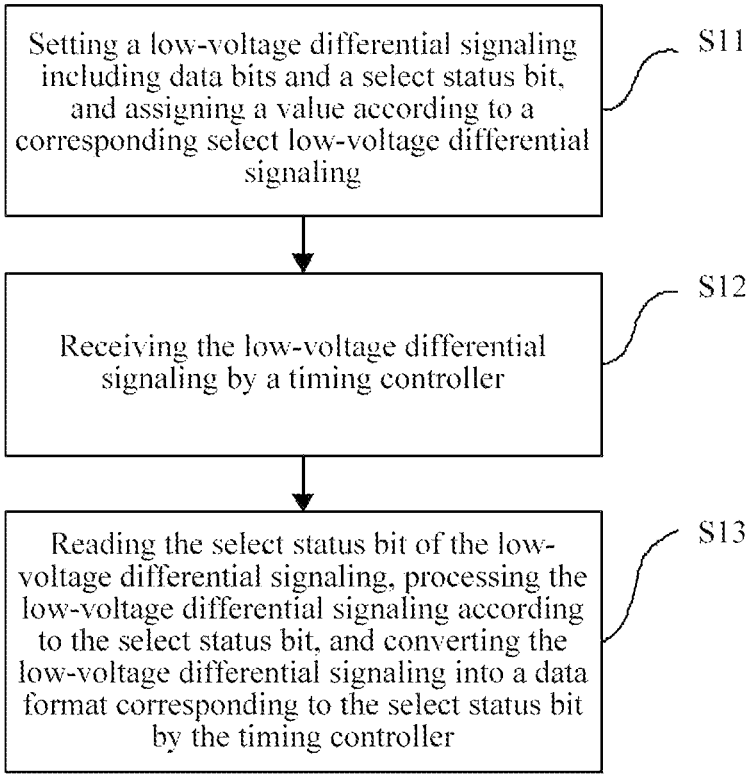
FIG. 1 is a process diagram of a data processing method for a display panel according to an embodiment of this application.

Specific structures and functional details disclosed herein are merely representative, and are intended to describe the objectives of exemplary embodiments of this application. However, this application may be specifically implemented in many alternative forms, and should not be construed as being, limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated. "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

The following specifies this application with reference to the accompanying drawings and alternative embodiments.

In the current TFT-LCD TV market, most of the input transmission assistance is Low-Voltage Differential Signaling (LVDS), and the transmission color depth is more than 8 bits. Low-voltage differential signaling transmission protocols are arranged and transmitted in two formats (VESA and JEIDA) for Japanese customers and non-Japanese customers. The transmission format of low-voltage differential signaling is determined by the setting of external select low-voltage differential signaling (SELLVDS). The level of the select low-voltage differential signaling may be disturbed by external signaling. When the level of the select low-voltage differential signaling does not match the format of current transmitted low-voltage differential signaling, the display of images is abnormal.

According to the embodiments of this application, as shown in FIGS. 1 to 6, this application discloses a data processing method for a display panel, and a display apparatus.

A data processing method includes the steps:

S11: setting a low-voltage differential signaling including data bits and a select status bit, and assigning a value according to a corresponding select low-voltage differential signaling;

S12: receiving the low-voltage differential signaling by a timing controller; and

S13: reading the select status bit of the low-voltage differential signaling, processing the low-voltage differential signaling according to the select status bit, and converting the low-voltage differential signaling into a data format corresponding to the select status bit by the timing controller.

The transmission format of the low-voltage differential signaling of a display apparatus is determined by the select low-voltage differential signaling of the timing controller, and the level of the select low-voltage differential signaling may be disturbed by external factors, such as static electricity, causing an image abnormality when the level of the select low-voltage differential signaling does not match the format of current transmitted low-voltage differential signaling. A low-voltage differential signaling including data bits and a select status bit is set, and a value is assigned to the select status bit according to a corresponding select low-voltage differential signaling; then, a timing controller of a display panel receives the low-voltage differential signaling output by a driver board; finally, the timing controller reads the select status bit of the low-voltage differential signaling, processes the low-voltage differential signaling according to the select status bit and converts the low-voltage differential signaling into a data format corresponding to the select status bit; in this way, the function of the select low-voltage differential signaling is integrated, and even if the low-voltage differential signaling is disturbed by external signaling, as long as the select status bit can be read, the low-voltage differential signaling can be ensured to be converted into the corresponding data format, so that the stability of information transmission is improved, in addition, the number of the timing controller and low-voltage differential signaling input connectors is reduced, the number of traces is then reduced, the area of a printed circuit board is reduced, and the production cost is lowered.

As shown in FIGS. 3 to 6, which are exemplary assignment diagrams of the low-voltage differential signaling according to this application, the data length of the exemplary low-voltage differential signaling is 8 bits or more, where seven bits of the low-voltage differential signaling are data bits, and different assignment manners can be performed for the transmission of the data bits according to different situations of the display panel. In addition to this, there is still a redundant bit that does not record data, such as a reserved bit (RSVD) in useless bits, or other bit.

Figure 6:
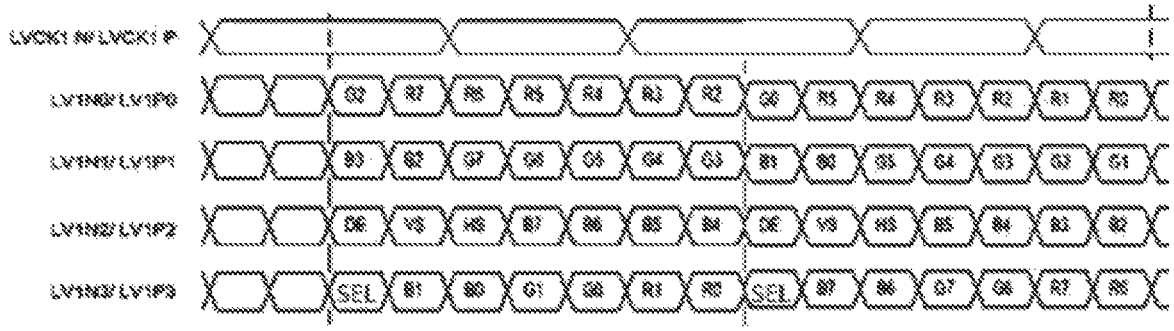
FIG. 6 is an exemplary assignment diagram of a low-voltage differential signaling including a select status bit according to an embodiment of this application.

As shown in FIG. 6, the reserved bit may be assigned with 1 or 0, that is, set as a select status bit (SEL). When the select status bit is assigned according to a select low-voltage differential signaling, the timing controller may output, according to different select status bits, one of two main data formats, such as a VESA format (VESA, Video Electronics Standards Association) and a JEIDA format (Japan Electronic Industry Development Association). Of course, if there are more than two data formats, the length of bits occupied by the select status bit may be increased according to the specific situation, but it should not be too long.

Figure 2:
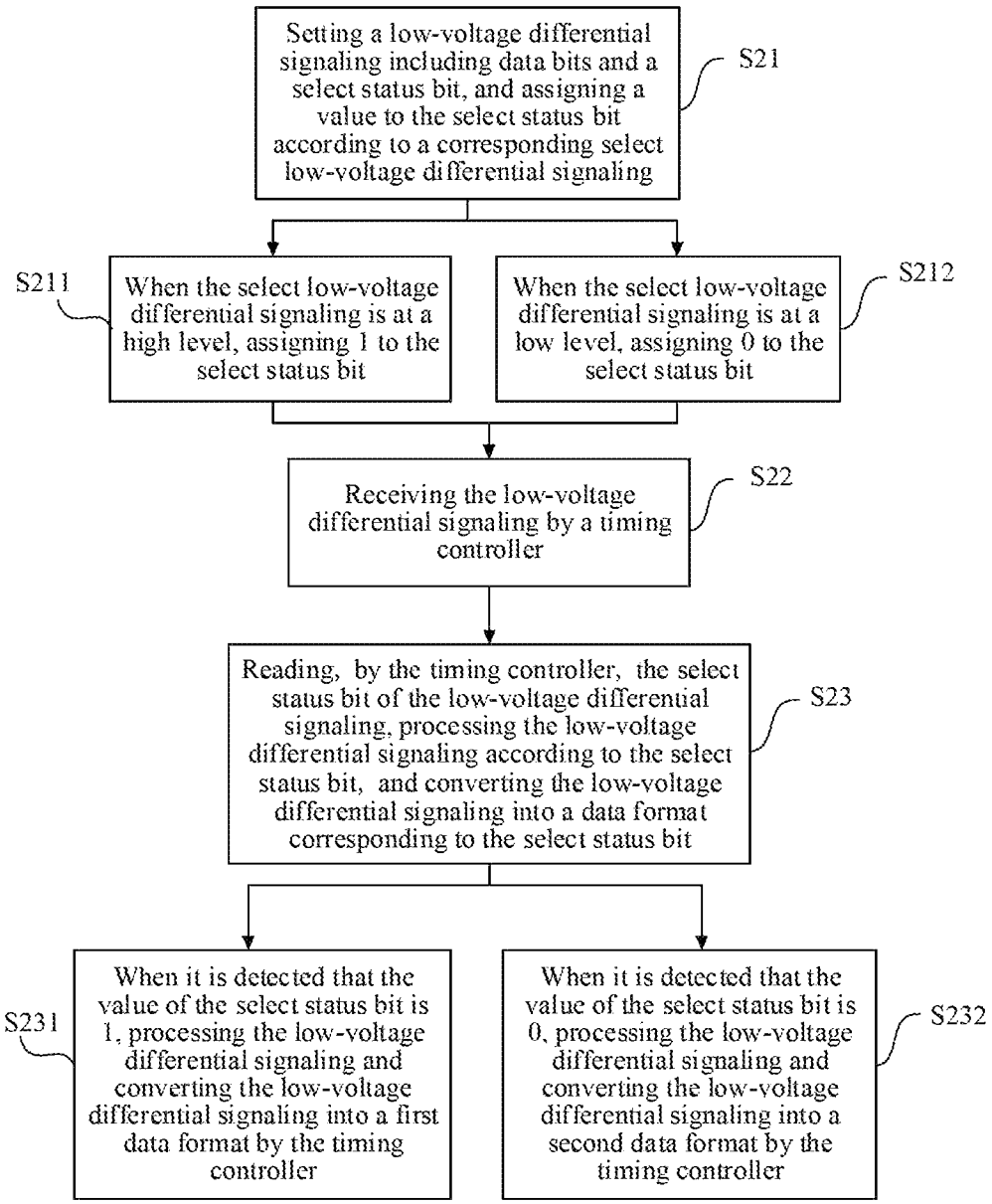
FIG. 2 is a process diagram of a data processing method for a display panel according to an embodiment of this application.
Figure 3:
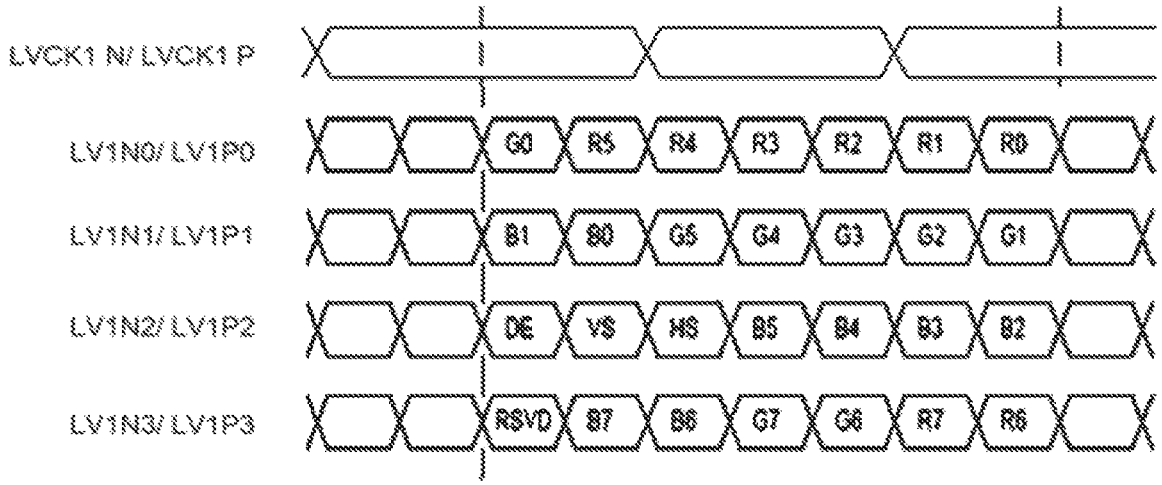
FIG. 3 is an exemplary assignment diagram of a low-voltage differential signaling according to an embodiment of this application.
Figure 4:
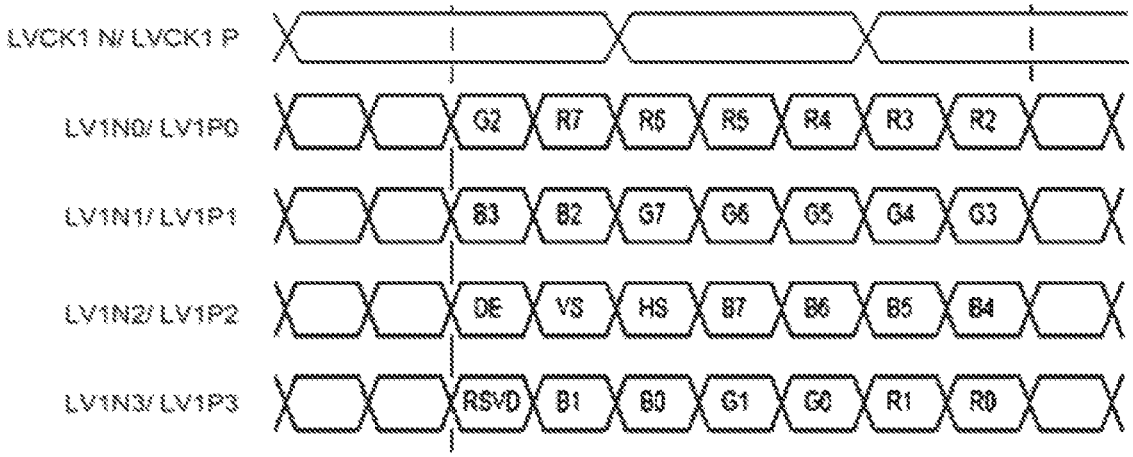
FIG. 4 is an exemplary assignment diagram of another low-voltage differential signaling according to an embodiment of this application.
Figure 5:
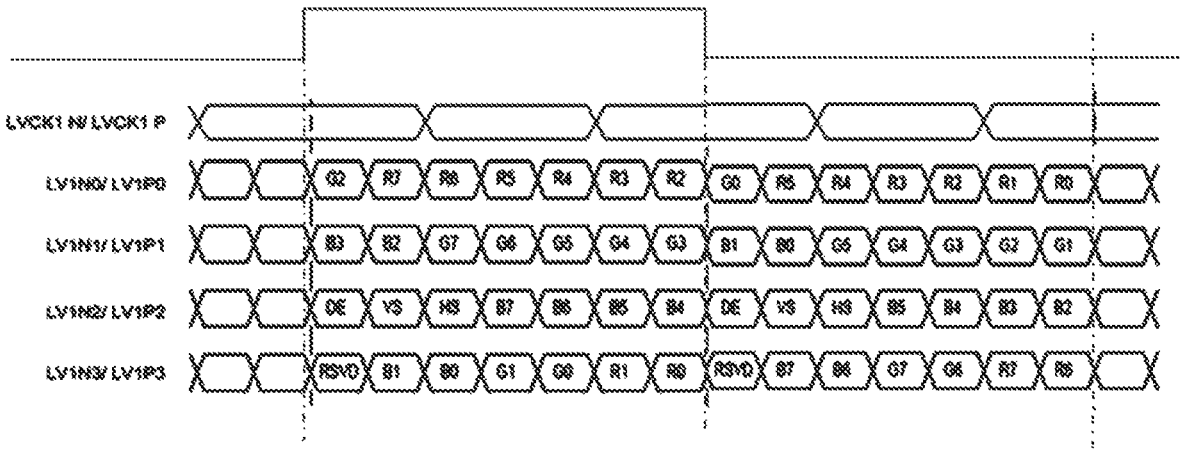
FIG. 5 is an exemplary assignment diagram of a further low-voltage differential signaling according to an embodiment of this application.

As shown in FIG. 2, which is a process diagram of a data processing method for a display panel according to an embodiment, the step that a low-voltage differential signaling including data bits and a select status bit is set, and a value is assigned according to a corresponding select low-voltage differential signaling includes that:

S211: when the select low-voltage differential signaling is at a high level, assigning 1 to the select status bit; and S212: when the select low-voltage differential signaling is at a low level, assigning 0 to the select status bit.

The select status bit is assigned with values according to different levels of the select low-voltage differential signaling, which conveniently and clearly replaces the function of the select low-voltage differential signaling to instruct the format selection of the low-voltage differential signaling, and facilitates subsequent processing and output of the low-voltage differential signaling by the timing controller in a correct data format according to the select status bit, thereby avoiding an image display abnormality caused by the received data mismatching in format during subsequent processing.

As shown in FIG. 2, in one or more embodiments, the step that the timing controller reads the select status bit of the low-voltage differential signaling, processes the low-voltage differential signaling according to the select status bit and converts the low-voltage differential signaling into a data format corresponding to the select status bit includes that:

S231: when it is detected that the value of the select status bit is 1, processing the low-voltage differential signaling and converting the low-voltage differential signaling into a first data format by the timing controller; and S232: when it is detected that the value of the select status bit is 0, processing the low-voltage differential signaling and converting the low-voltage differential signaling into a second data format by the timing controller.

The timing controller reads the select status bit of the low-voltage differential signaling, processes the low-voltage differential signaling according to the select status bit and converts the low-voltage differential signaling into a data format corresponding to the select status bit to output the first data format or the second data format. In this way, the timing controller can quickly output the data format of the accurate signaling format, thereby reducing, or even eliminating the abnormality of image display; in addition, in the presence of the select status bit of the select low-voltage differential signaling, the summarized select low-voltage differential signaling may be omitted, thereby reducing the number of the timing controller and low-voltage differential signaling input connectors, reducing the number of traces of the timing controller and low-voltage differential signaling connectors on a printed circuit board, reducing the area of the printed circuit board, and lowering the production cost. This solution corresponds to the case of two data formats. If there are more than two data formats, the data length of the select status bit may be set to be longer than 1 bit, and enabling the assignment of the select status bit to correspond to the data format.

In one or more embodiments, the display panel further includes a low-voltage differential mode select circuit configured to output a select low-voltage differential signaling corresponding to the low-voltage differential signaling to the timing controller; the step that a timing controller receives the low-voltage differential signaling includes that:

detecting whether the low-voltage differential signaling includes the select status bit, and if the low-voltage differential signaling includes the select status bit, turning off the low-voltage differential mode select circuit:

if the low-voltage differential signaling does not include the select status bit, outputting, by the low-voltage differential mode select circuit, a select low-voltage differential signaling to the timing controller according to the low-voltage differential signaling without the select status bit; and processing, by the timing controller, the low-voltage differential signaling according to the select low-voltage differential signaling, and converting the low-voltage differential signaling into a data format corresponding to the select low-voltage differential signaling.

The low-voltage differential mode select circuit is reserved and used as a supplement and backup for this application. When the display panel and the driver board do not support reading the low-voltage differential signaling including the select status bit, the low-voltage differential mode select circuit can be controlled to be turned on, and the select low-voltage differential signaling transmitted by the low-voltage differential mode select circuit is then used to instruct the timing controller to perform decompression and output of the matched data format. The two methods are complementary, and are suitable for more display panels to ensure the correctness of conversion and output of the data format, thereby ensuring the display quality of displayed images.

As shown in FIG. 1 and FIG. 2, it may be known in combination with FIG. 1 that this application further provides a data processing method for a display panel, including the steps that:

S21: setting a low-voltage differential signaling including data bits and a select status bit, and assigning a value to the select status bit according to a corresponding select low-voltage differential signaling;

S22: receiving the low-voltage differential signaling by a timing controller; and S23: reading, by the timing controller, the select status bit of the low-voltage differential signaling, processing the low-voltage differential signaling according to the select status bit and converting the low-voltage differential signaling into a data format corresponding to the select status bit;

where after the step of setting a low-voltage differential signaling including data bits and a select status bit, and assigning a value to the select status bit according to a corresponding select low-voltage differential signaling further includes steps of:

S211: when the select low-voltage differential signaling is at a high level, assigning 1 to the select status bit; and S212: when the select low-voltage differential signaling is at a low level, assigning 0 to the select status bit; and where after the step of reading, by the timing controller, the select status bit of the low-voltage differential signaling, processing the low-voltage differential signaling according, to the select status bit and converting the low-voltage differential signaling into a data format corresponding to the select status bit further includes steps of:

S231: when it is detected that the value of the select status bit is 1, processing the low-voltage differential signaling and converting the low-voltage differential signaling into a first data format by the timing controller; and S232: when it is detected that the value of the select status bit is 0, processing the low-voltage differential signaling and converting the low-voltage differential signaling into a second data format by the timing controller.

The select low-voltage differential signaling information is integrated into the low-voltage differential signaling information, that is, the useless reserved bit (RSVD) in the fourth pair of the low-voltage differential signaling is defined as a select status bit (SEL); when 1 is assigned to the select status bit, the corresponding transmission format of the low-voltage differential signaling is the first data format; when 0 is assigned to the select status bit (SEL), the corresponding transmission format of the low-voltage differential signaling is the second data format; in this way, the select low-voltage differential signaling is integrated into the low-voltage differential signaling, thereby strengthening the anti-interference performance, reducing the number of input port connectors corresponding to the low-voltage differential mode select circuit, corresponding circuit traces, and the number of the timing controller in the conventional design, improving the transmission quality, lowering the cost, and optimizing the space of the panel.

Of course, the first data format and the second data format may be a VESA picture format (VESA, Video Electronics Standards Association) and a JEIDA picture format (Japan Electronic Industry Development Association), or other applicable data formats.

Figure 7:
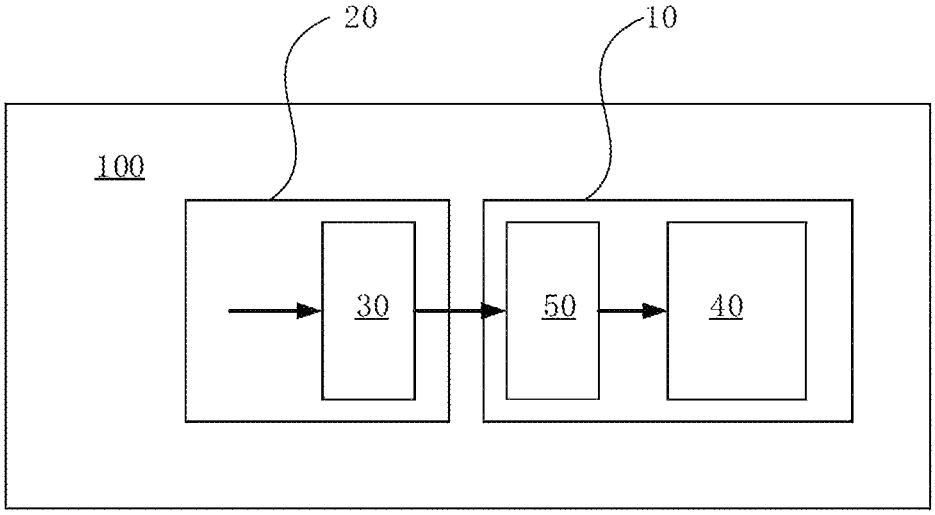
FIG. 7 is a schematic diagram of a display apparatus according to an embodiment of this application.
Figure 8:
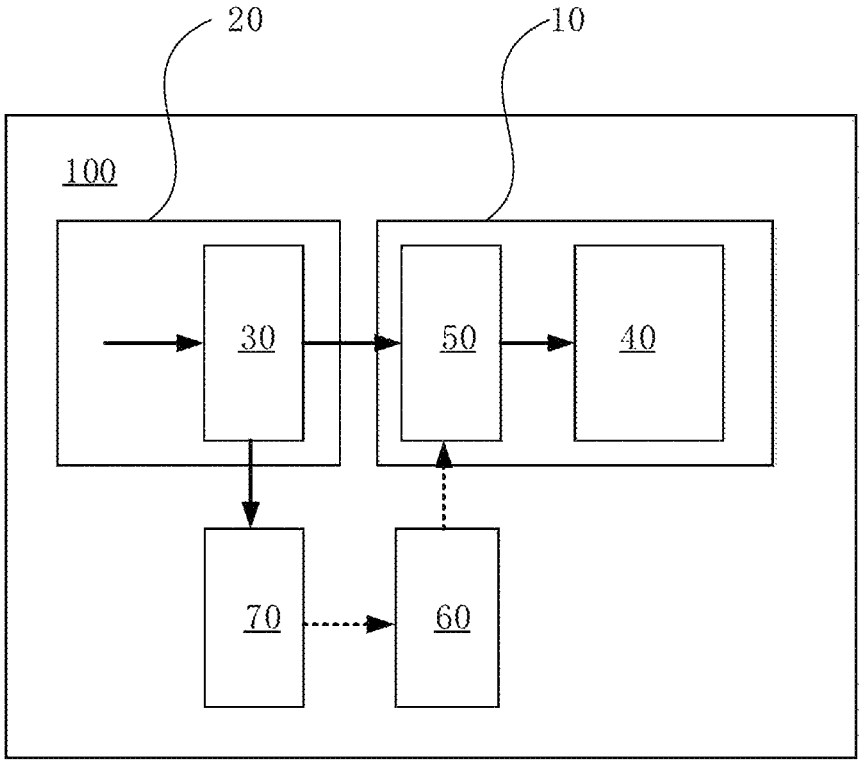
FIG. 8 is a schematic diagram of another display apparatus according to an embodiment of this application.

In one or more embodiments, as shown in FIG. 7 and FIG. 8, which are respectively schematic diagrams of a display apparatus according to an embodiment of this application, it may be seen in combination with FIG. 1 and FIG. 2 that this application further discloses a display apparatus 100, including: a driver board 20; a display panel 10 electrically connected with the driver board 20; a transmitter 30 arranged on the driver board 20 and configured to transmit a low-voltage differential signaling to the display panel 10; a receiver 50 arranged on the display panel 10 and configured to receive the low-voltage differential signaling; and a timing controller 40 arranged on the display panel 10, the timing controller 40 reading a select status bit of the low-voltage differential signaling, processing the low-voltage differential signaling according to the select status bit and converting the low-voltage differential signaling into a data format corresponding to the select status bit, and the low-voltage differential signaling including data bits and the select status bit.

A low-voltage differential signaling including data bits and a select status bit is set; a value is assigned to the select status bit according to a corresponding select low-voltage differential signaling; then, a timing controller of a display panel reads the select status bit of the low-voltage differential signaling, processes the low-voltage differential signaling according to the select status bit and converts the low-voltage differential signaling into a data format corresponding to the select status bit; in this way, the function of the select low-voltage differential signaling is integrated, and even if the low-voltage differential signaling is disturbed by external signaling, as long as the select status bit can be read, the low-voltage differential signaling can be ensured to be converted into the corresponding data format, so that the stability of information transmission is improved, in addition, the number of the timing controller and low-voltage differential signaling input connectors is reduced, the number of traces is then reduced, the area of a printed circuit board is reduced, and the production cost is lowered.

In one or more embodiments, the transmitter 30 is further configured to assign a value to the select status bit according to a corresponding select low-voltage differential signaling. The transmitter 30 may be improved to assign a value to the select status bit according to the select low-voltage differential signaling. Of course, the setting and assignment of the select status bit may also be completed by an additional circuit or chip or before the driver board receives the low-voltage differential signaling.

In one or more embodiments, 1 or 0 is assigned to the select status bit the data format includes a first data format and a second data format corresponding to the assigned values respectively; when detecting that the value of the select status bit is 1, the timing controller 40 processes the low-voltage differential signaling and converts the low-voltage differential signaling into the first data format; and when detecting that the value of the select status bit is 0, the timing controller 40 processes the low-voltage differential signaling and converts the low-voltage differential signaling into the second data format.

The assignment of the select status bit with 1 or 0 corresponds to two different data formats. The first data format and the second data format are respectively a VESA data format (VESA, Video Electronics Standards Association) and a JEIDA data format (Japan Electronic Industry Development Association). Of course, other data formats are also applicable. The data length of the select status bit is adjusted according to the actual situation, as long as the assignment corresponds to the data format.

In one or more embodiments, the display panel 10 further includes a low-voltage differential mode select circuit 60 coupled between the transmitter 30 and the receiver 50, and a switching circuit 70 coupled to the driver board 20 configured to control, on or off of the low-voltage differential mode select circuit 60; the driver board 10 detects whether the low-voltage differential signaling includes the select status bit, and if the low-voltage differential signaling includes the select status bit, the switching circuit 70 is controlled to turn off the low-voltage differential mode select circuit 60.

If the low-voltage differential signaling does not include the select status bit, the switching circuit 70 is controlled to turn on the low-voltage differential mode select circuit 60, and the low-voltage differential mode select circuit 60 outputs a select low-voltage differential signaling to the timing controller 40 according to the low-voltage differential signaling. The display apparatus 100 is further provided with the low-voltage differential mode select circuit 60. According to the exemplary technical solution of two-mode selection in this application, the display apparatus 100 may use the low-voltage differential mode select circuit to transmit a select low-voltage differential signaling to the timing controller 40 to control the output of the corresponding data format, or a low-voltage differential signaling including the select status bit assigned according to a select low-voltage differential signaling is preset to control the output of the corresponding data format, and a plurality of timing controllers with different functions.

In one or more embodiments, the timing controller 40 processes the low-voltage differential signaling according to the select low-voltage differential signaling or the select status bit and converts the low-voltage differential signaling into a corresponding data format. Thus, even if the timing controller 40 in the display panel 10 is not improved corresponding to the select status bit, the timing controller 40 can also process the low-voltage differential signaling by additionally reading the select low-voltage differential signaling transmitted by the low-voltage differential mode select circuit 60.

It should be noted that the limitation of each step involved in this solution is not considered to limit the sequence of steps on the premise of not affecting the implementation of the specific, solution. The steps written in front may be executed first, or later, or simultaneously. As long as this solution can be implemented, any sequence of the steps falls into the scope of this application.

The technical solution of this application may be widely applied to a Twisted Nematic (TN) panel, an In-Plane Switching (IPS) panel, or a Multi-domain Vertical Alignment (VA) panel, and may certainly be applied to any other suitable type of panel.

The foregoing content describes this application in detail with reference to the specific implementation manners, and it should not be regarded that the specific implementations of this application are limited to these descriptions. Persons of ordinary skill in the art can further make simple deductions or replacements without departing from the concept of this application, and such deductions or replacements should all be considered as falling within the protection scope of this application

What is claimed is:

1. A data processing method for a display panel, comprising steps of:

setting a low-voltage differential signaling comprising data bits and a select status bit, and assigning a value to the select status bit according to a corresponding select low-voltage differential signaling;

receiving the low-voltage differential signaling by a timing controller; and reading the select status bit of the low-voltage differential signaling, processing the low-voltage differential signaling according to the select status bit, and converting the low-voltage differential signaling into a data format corresponding to the select status bit by the timing controller;

wherein the display panel further comprises a low-voltage differential mode select circuit configured to output a select low-voltage differential signaling corresponding to the low-voltage differential signaling to the timing controller; and the step of receiving the low-voltage differential signaling by a timing controller of the display panel comprises:

detecting whether the low-voltage differential signaling comprises the select status bit, and if the low-voltage differential signaling comprises the select status bit, turning off the low-voltage differential mode select circuit.

2. The data processing method for a display panel according to claim 1, wherein in the step of setting a low-voltage differential signaling comprising data bits and a select status bit, and assigning a value to the select status bit according to a corresponding select low-voltage differential signaling:

when the select low-voltage differential signaling is at a high level, 1 is assigned to the select status bit.

3. The data processing method for a display panel according to claim 2, wherein in the step of setting a low-voltage differential signaling comprising data bits and a select status bit, and assigning a value to the select status bit according to a corresponding select low-voltage differential signaling:

when the select low-voltage differential signaling is at a low level, 0 is assigned to the select status bit.

4. The data processing method for a display panel according to claim 3, wherein the step of reading the select status bit of the low-voltage differential signaling, processing the low-voltage differential signaling according to the select status bit, and converting the low-voltage differential signaling into a data format corresponding to the select status bit by the timing controller comprises:

when it is detected that the value of the select status bit is 1, processing the low-voltage differential signaling and converting the low-voltage differential signaling into a first data format by the timing controller.

5. The data processing method for a display panel according to claim 4, wherein the step of reading the select status bit of the low-voltage differential signaling, processing the low-voltage differential signaling according to the select status bit, and converting the low-voltage differential signaling into a data format corresponding to the select status bit by the timing controller comprises:

when it is detected that the value of the select status bit is 0, processing the low-voltage differential signaling and converting the low-voltage differential signaling into a second data format by the timing controller.

6. The data processing method for a display panel according to claim 1, wherein after the timing controller of the display panel receives the low-voltage differential signaling, the method comprises the step of:

detecting whether the low-voltage differential signaling comprises the select status bit, and if the low-voltage differential signaling does not comprise the select status bit, outputting, by the low-voltage differential mode select circuit, a select low-voltage differential signaling to the timing controller according to the low-voltage differential signaling without the select status bit.

7. The data processing method for a display panel according to claim 6, wherein the timing controller processes the low-voltage differential signaling according to the select low-voltage differential signaling, and converts the low-voltage differential signaling into a data format corresponding to the select low-voltage differential signaling.

8. The data processing method for a display panel according to claim 1, wherein the data length of the low-voltage differential signaling is more than or equal to 8 bits.

9. A data processing method for a display panel, comprising steps of:

setting a low-voltage differential signaling comprising data bits and a select status bit, and assigning a value to the select status bit according to a corresponding select low-voltage differential signaling;

receiving the low-voltage differential signaling by a timing controller; and reading, by the timing controller, the select status bit of the low-voltage differential signaling, processing the low-voltage differential signaling according to the select status bit, and converting the low-voltage differential signaling into a data format corresponding to the select status bit;

wherein after the step of setting a low-voltage differential signaling including data bits and a select status bit, and assigning a value to the select status bit according to a corresponding select low-voltage differential signaling further comprises steps of when the select low-voltage differential signaling is at a high level, assigning 1 to the select status bit; and when the select low-voltage differential signaling is at a low level, assigning 0 to the select status bit; and wherein after the step of reading, by the timing controller, the select status bit of the low-voltage differential signaling, processing the low-voltage differential signaling according to the select status bit and converting the low-voltage differential signaling into a data format corresponding to the select status bit further comprises steps of:

when it is detected that the value of the select status bit is 1, processing the low-voltage differential signaling and converting the low-voltage differential signaling into a first data format by the timing controller; and when it is detected that the value of the select status bit is 0, processing the low-voltage differential signaling and converting the low-voltage differential signaling into a second data format by the timing controller;

wherein the display panel further comprises a low-voltage differential mode select circuit configured to output a select low-voltage differential signaling corresponding to the low-voltage differential signaling to the timing controller; and the step of receiving the low-voltage differential signaling by a timing controller of the display panel comprises:

detecting whether the low-voltage differential signaling comprises the select status bit, and if the low-voltage differential signaling comprises the select status bit, turning off the low-voltage differential mode select circuit.

10. A display apparatus, comprising:

a driver board;

a display panel electrically connected with the driver board;

a transmitter arranged on the driver board and configured to transmit a low-voltage differential signaling to the display panel;

a receiver arranged on the display panel and configured to receive the low-voltage differential signaling; and a timing controller arranged on the display panel, electrically connected with the receiver, and configured to read a select status bit of the low-voltage differential signaling, process the low-voltage differential signaling according to the select status bit and convert the low-voltage differential signaling into a data format corresponding to the select status bit;

wherein the low-voltage differential signaling comprises data bits and the select status bit;

wherein 1 or 0 is assigned to the select status bit; the data format comprises a first data format and a second data format corresponding to the assigned values respectively;

when detecting that the value of the select status bit is 1, the timing controller processes the low-voltage differential signaling and converts the low-voltage differential signaling into the first data format; and when detecting that the value of the select status bit is 0, the timing controller processes the low-voltage differential signaling and converts the low-voltage differential signaling into the second data format;

wherein the display panel further comprises a low-voltage differential mode select circuit coupled between the transmitter and the receiver, and a switching circuit coupled to the driver board and configured to control on or off of the low-voltage differential mode select circuit;

the driver board is further configured to detect whether the low-voltage differential signaling comprises a select status bit, and if the low-voltage differential signaling comprises the select status bit, the switching circuit is controlled to turn off the low-voltage differential mode select circuit; and if the low-voltage differential signaling does not comprise the select status bit, the switching circuit is controlled to turn on the low-voltage differential mode select circuit, and the low-voltage differential mode select circuit outputs a select low-voltage differential signaling to the timing controller according to the low-voltage differential signaling.

11. The display apparatus according to claim 10, wherein the transmitter is further configured to assign a value to the select status bit according to a corresponding select low-voltage differential signaling.

12. The display apparatus according to claim 10, wherein the timing controller processes the low-voltage differential signaling according to the select low-voltage differential signaling or the select status bit, and converts the low-voltage differential signaling into a corresponding data format.

13. The display apparatus according to claim 10, wherein the select low-voltage differential signaling transmitted by the low-voltage differential mode select circuit instructs the timing controller to perform decompression and output of the matched data format.

14. The display apparatus according to claim 10, wherein the display panel is one of a Twisted Nematic Display Panel, an In-Plane Switching Display Panel, and a Multi-Domain Vertical Alignment Display Panel.

* * * * *